US008579429B2

(12) United States Patent
Itogawa

(10) Patent No.: US 8,579,429 B2
(45) Date of Patent: Nov. 12, 2013

(54) DROPLET EJECTION DEVICE THAT APPLIES TREATING AGENT TO RECORDING MEDIUM

(75) Inventor: Yoshihiro Itogawa, Gifu-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 266 days.

(21) Appl. No.: 12/966,498

(22) Filed: Dec. 13, 2010

(65) Prior Publication Data

US 2011/0210996 A1 Sep. 1, 2011

(30) Foreign Application Priority Data

Feb. 26, 2010 (JP) ..... 2010-041623

(51) Int. Cl.
*B41J 2/01* (2006.01)

(52) U.S. Cl.
USPC ..... 347/101; 347/9; 347/19

(58) Field of Classification Search
USPC ..... 347/5, 9, 16, 19, 101
See application file for complete search history.

(56) References Cited

U.S. PATENT DOCUMENTS

| | | | | |
|---|---|---|---|---|
| 5,635,969 | A | 6/1997 | Allen | |
| 5,663,750 | A | 9/1997 | Sakuma | |
| 6,012,809 | A | 1/2000 | Ikeda et al. | |
| 6,126,281 | A * | 10/2000 | Shimoda et al. | 347/101 |
| 6,299,285 | B1 | 10/2001 | Inui | |
| 7,695,090 | B2 * | 4/2010 | Kawamura et al. | 347/19 |
| 2006/0066653 | A1 | 3/2006 | Konno | |
| 2006/0203029 | A1 | 9/2006 | Nishida et al. | |
| 2007/0019015 | A1 | 1/2007 | Tatsumi | |
| 2007/0126836 | A1 | 6/2007 | Masuyama et al. | |

FOREIGN PATENT DOCUMENTS

| | | | |
|---|---|---|---|
| JP | H07-195823 | A | 8/1995 |
| JP | H07-276664 | A | 10/1995 |
| JP | H08-183203 | A | 7/1996 |
| JP | H08-216393 | A | 8/1996 |
| JP | H09-254376 | A | 9/1997 |
| JP | H10-076648 | A | 3/1998 |
| JP | H10-226057 | A | 8/1998 |
| JP | H11-099670 | A | 4/1999 |
| JP | 2001-334700 | A | 12/2001 |
| JP | 2002-321349 | A | 11/2002 |

(Continued)

OTHER PUBLICATIONS

Japan Patent Office, Office Action for Japanese Patent Application No. 2010-041623 (counterpart to above-captioned patent application), mailed Feb. 14, 2012.

*Primary Examiner* — Lam S Nguyen
(74) *Attorney, Agent, or Firm* — Baker Botts L.L.P.

(57) ABSTRACT

A droplet ejection device includes a head that ejects droplets onto a recording medium so as to form an image, an extract unit that extracts a part of the image as a specific image portion, and a control unit that controls a treating-agent application member to apply treating agent to a first section and a second section of the recording medium. The specific image portion is formed in the first section, and at least a part of a non-specific image portion of the image is formed in the second section. When a remaining amount of the treating agent is less than a first amount, the treating-agent application member applies the treating agent to the second section by an amount less than an amount of the treating agent that is applied to the second section when the remaining amount is not less than the first amount.

13 Claims, 9 Drawing Sheets

(56) References Cited

FOREIGN PATENT DOCUMENTS

| | | | |
|---|---|---|---|
| JP | 2004-110585 | A | 4/2004 |
| JP | 2005-053007 | A | 3/2005 |
| JP | 2005-096365 | A | 4/2005 |
| JP | 2005-178009 | A | 7/2005 |
| JP | 2005-212183 | A | 8/2005 |
| JP | 2006-095768 | A | 4/2006 |
| JP | 2006-247965 | A | 9/2006 |
| JP | 2006-264185 | A | 10/2006 |
| JP | 2007-021986 | A | 2/2007 |
| JP | 2007-152850 | A | 6/2007 |
| JP | 2008-143051 | A | 6/2008 |

* cited by examiner

DROPLET EJECTION DEVICE THAT APPLIES TREATING AGENT TO RECORDING MEDIUM

CROSS REFERENCE TO RELATED APPLICATION

This application claims priority from Japanese Patent Application No. 2010-041623 filed Feb. 26, 2010. The entire content of this priority application is incorporated herein by reference.

TECHNICAL FIELD

The present invention relates to a droplet ejection device for ejecting a droplet of ink or the like and also to a control device for controlling the droplet ejection device.

BACKGROUND

There has been proposed an inkjet printer that applies a treating agent to a recording medium prior to and/or after ink ejection to the recording medium. The treating agent is liquid or solid (film-shaped, for example) agent with desired characteristics.

A treating agent that is applied prior to ink ejection (pre-treating agent) prevents ink blur and ink seep through, improves color development, reduces dry time, and prevents recording medium cockle and curl that may occur after ink ejection. Note that "ink seep through" means that ink ejected on a surface of a recording medium seeps through the recording medium to the other side thereof. A treating agent that is applied after ink ejection (post-treating agent) forms a layer to protect images formed on a recording medium by improving rub resistance, water resistance, light resistance, gas resistance, and the like, and to produce gross on the surface of the recording medium.

There is also known a method for suppressing ink blur and the like by reducing the ejection amount of ink droplets without using a treating agent when the remaining amount of the treating agent is low.

SUMMARY

However, even if the ejection amount of ink droplets is reduced, degradation in image quality due to ink blur or the like may be inevitable if no treating agent is used, and it is difficult to secure certain level of image quality.

In view of the foregoing, it is an object of the invention to provide a droplet ejection device capable of securing certain level of image quality by using a treating agent even if the remaining amount of the treating agent is low, and also to provide a control device for controlling the droplet ejection device.

In order to attain the above and other objects, the invention provides a droplet ejection device including a first storing unit that stores image data, a head that ejects droplets onto a recording medium so as to form an image corresponding to the image data, a treating-agent application member that applies a treating agent to the recording medium, an extract unit that extracts a part of the image as a specific image portion based on the image data, a control unit that controls the treating-agent application member to apply the treating agent to a first section and a second section of the recording medium, a detection unit that detects a remaining amount of the treating agent, and a first determining unit that determines whether or not the remaining amount is less than a first amount. The specific image portion is formed in the first section, and at least a part of a non-specific image portion of the image other than the specific image portion is formed in the second section. When the remaining amount is less than the first amount, the control unit controls the treating-agent application member to apply the treating agent to the second section by an amount less than an amount of the treating agent that is applied to the second section when the remaining amount is not less than the first amount.

According to another aspect, the present invention provides a control device that controls a droplet ejection device including a head that ejects droplets onto a recording medium so as to form an image corresponding to image data and a treating-agent application member that applies a treating agent to the recording medium. The control device includes a first storing unit that stores the image data, an extract unit that extracts a part of the image as a specific image portion based on the image data, a control unit that controls the treating-agent application member to apply the treating agent to a first section and a second section of the recording medium, a detection unit that detects a remaining amount of the treating agent, and a first determining unit that determines whether or not the remaining amount is less than a first amount. The specific image portion is formed in the first section, and at least a part of a non-specific image portion of the image other than the specific image portion is formed in the second section. When the remaining amount is less than the first amount, the control unit controls the treating-agent application member to apply the treating agent to the second section by an amount less than an amount of the treating agent that is applied to the second section when the remaining amount is not less than the first amount.

According to still another aspect, the present invention provides a non-transitory computer readable storage medium storing a set of program instructions installed on an executed by a computer for controlling a droplet ejection device including a head that ejects droplets onto a recording medium so as to form an image corresponding to image data and a treating-agent application member that applies a treating agent to the recording medium. The program instructions includes: an extract unit that extracts a part of the image as a specific image portion based on the image data stored in a storing unit; controlling the treating-agent application member to apply the treating agent to a first section and a second section of the recording medium, wherein the specific image portion is formed in the first section, and at least a part of a non-specific image portion of the image other than the specific image portion is formed in the second section; detecting a remaining amount of the treating agent; and determining whether or not the remaining amount is less than a first amount. When the remaining amount is less than the first amount, the treating-agent application member is controlled to apply the treating agent to the second section by an amount less than an amount of the treating agent that is applied to the second section when the remaining amount is not less than the first amount.

BRIEF DESCRIPTION OF THE DRAWINGS

The particular features and advantages of the invention as well as other objects will become apparent from the following description taken in connection with the accompanying drawings, in which.

DETAILED DESCRIPTION

Figure 1:
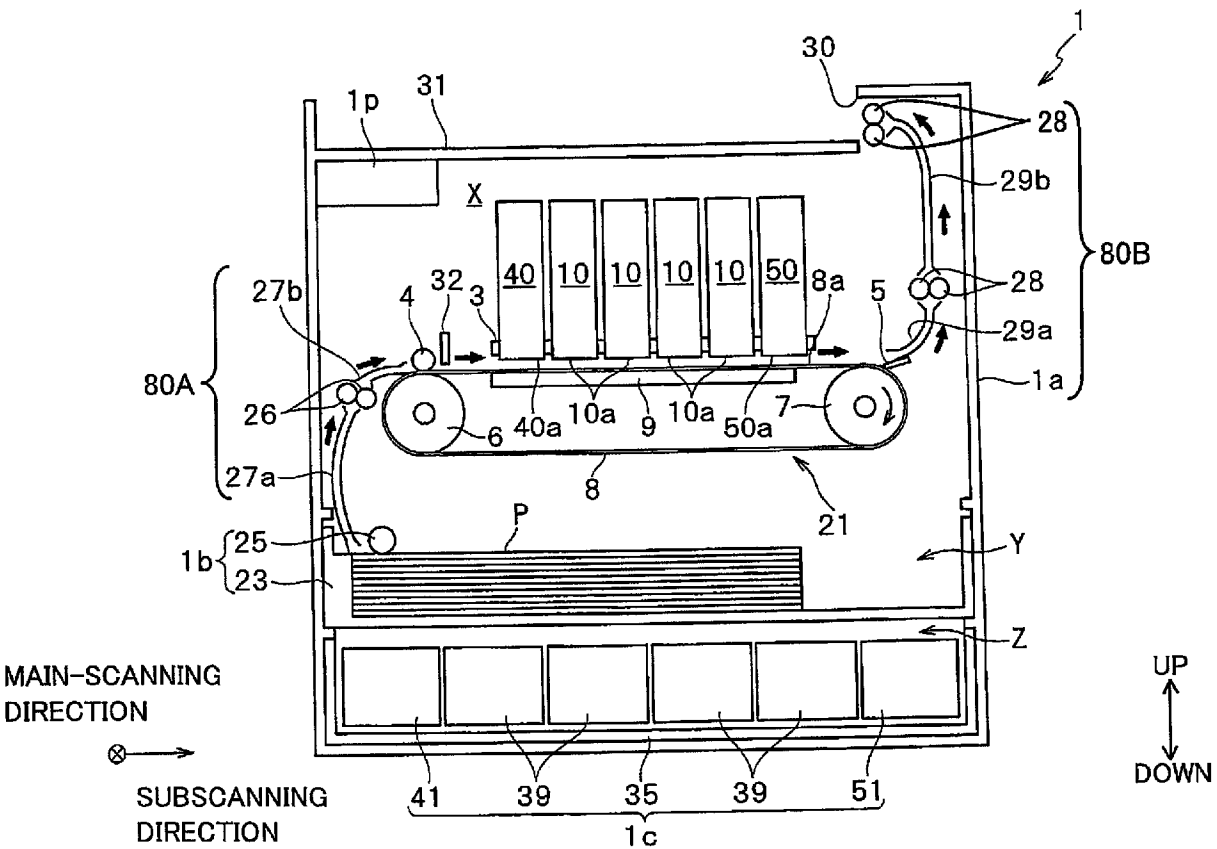
FIG. 1 is an explanatory cross-sectional plan view of an inkjet printer according to an embodiment of the invention.

A droplet ejection device according to an embodiment of the invention will be described while referring to the accompanying drawings wherein like parts and components are designated by the same reference numerals to avoid duplicating description. The embodiment pertains to an inkjet printer 1 shown in FIG. 1.

The terms "up," "down," "upward," "beneath," and the like will be used throughout the description assuming that the inkjet printer 1 is disposed in an orientation in which it is intended to be used. In use, the inkjet printer 1 is disposed as shown in FIG. 1.

As shown in FIG. 1, the inkjet printer 1 includes a box-shaped casing 1*a*, which is provided with a discharge section 31 on top thereof and defining inner spaces X, Y, and Z in the order of up to down.

The casing 1*a* accommodates in the inner space X a pre-coat head 40, a post-coat head 50, and four inkjet heads 10 disposed between the pre-coat head 40 and the post-coat head 50 in a subscanning direction, a conveying unit 21 for conveying a paper sheet P, and an upstream guide 80A and a downstream guide 80B for guiding the paper sheet P. The casing 1*a* also accommodates at an upper section in the inner space X a control device 1*p* for performing overall control of the inkjet printer 1 by controlling operation of each component of the inkjet printer 1. The control device 1*p* controls printing operation based on image data (image data for an image to be printed on the paper sheet P) received from an external device. The printing operation includes an operation for conveying the paper sheet P by various components of the inkjet printer 1, an operation for ejecting droplets of ink, pre-treating agent, and post-treating agent in synchronization of conveyance of the paper sheet P, and the like. Note that the pre-treating agent and the post-treating agent will be collectively referred to as "treating agents." Details of the printing operation will be described later.

The conveying unit 21 includes a follow roller 6, a drive roller 7, an endless conveying belt 8 wound around and extended between the rollers 6 and 7, a nip roller 4 and a separating plate 5 disposed outside the conveying belt 8, and a platen 9 disposed inside the conveying belt 8. The drive roller 7 is driven to rotate by a conveying motor 121 (FIG. 5) in a clockwise direction in FIG. 1. Rotation of the belt roller 7 circulates the conveying belt 8 in the clockwise direction in FIG. 1, which in turn rotates the follow roller 6 in the clockwise direction in FIG. 1. The nip roller 4 is disposed in confrontation with the follow roller 6 and presses the paper sheet P onto a support surface 8*a*, which is an outer surface of the conveying belt 8. The paper sheet P pressed onto the support, surface 8*a* by the nip roller 4 is held on the support surface 8*a* and conveyed toward the drive roller 7 by the circulation of the conveying belt 8. The separating plate 5 is disposed in confrontation with the drive roller 7 and separates the paper sheet P from the support surface 8*a* of the conveying belt 8 such that the paper sheet P is further conveyed toward the downstream side of a sheet conveying path, which is defined in the inner spaces X and Y. The platen 9 is disposed in confrontation with all of the pre-coat head 40, the post-coat head 50, and the four inkjet heads 10, and supports an upper section of the conveying belt 8 from below.

Figure 3:
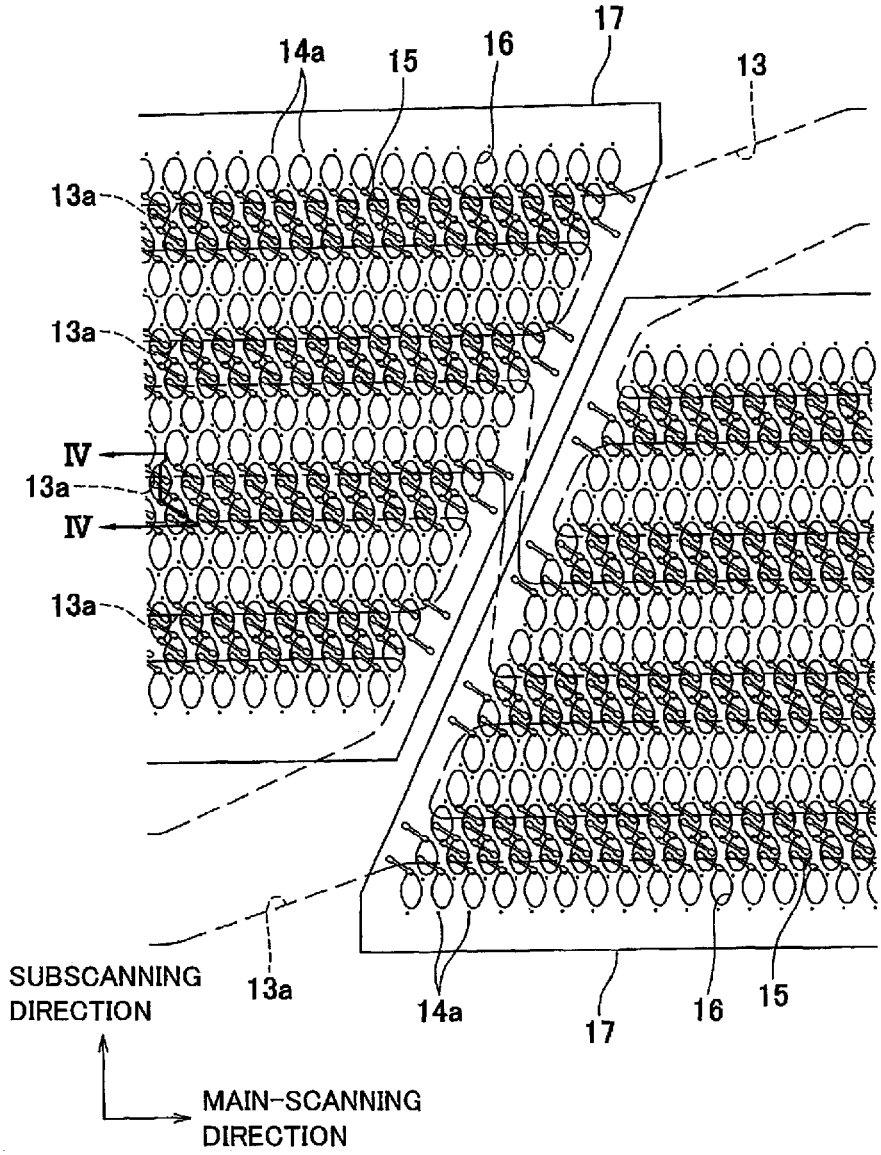
FIG. 3 is an enlarged view of a part of FIG. 2 encircled by a single-dot chain line III.
Figure 4:
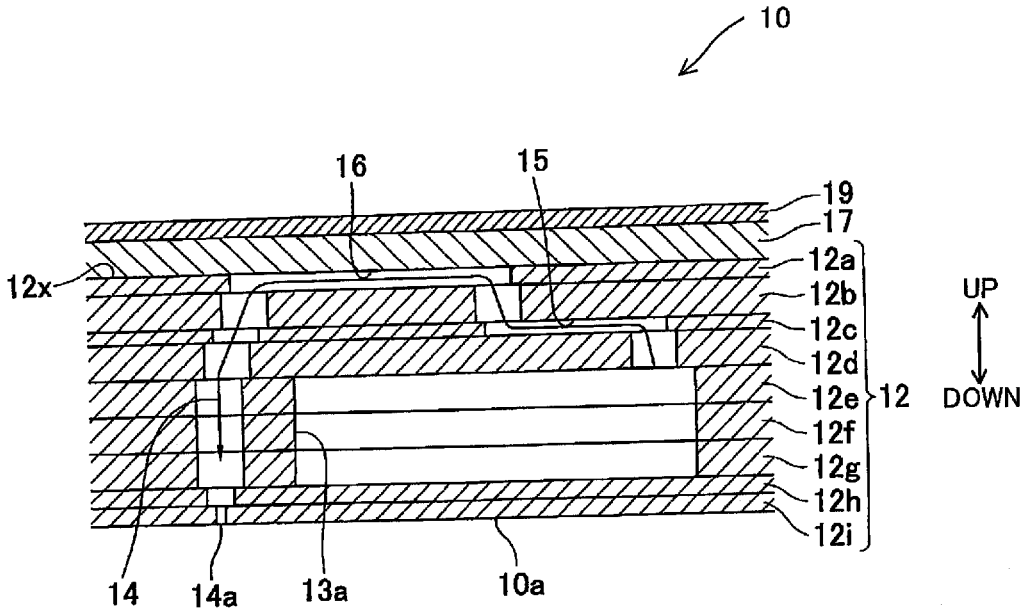
FIG. 4 is a cross-sectional view taken along a line IV-IV of FIG. 3.

Each of the heads 10, 40, and 50 is a box-shaped line head having a long dimension in a main-scanning direction, and has on its bottom an ejection surface 10*a*, 40*a*, 50*a* formed with a plurality of nozzles. (FIGS. 3 and 4 show nozzles 14*a* of the inkjet heads 10.) During printing, ink droplets of black, magenta, cyan, and yellow are respectively ejected from the ejection surfaces 10*a* of the inkjet heads 10. Also, as will be described later, droplets of the pre-treating agent are ejected from the ejection surface 40*a* of the pre-coat head 40 onto the paper sheet P as needed before ink droplets impinge the paper sheet P, and droplets of the post-treating agent are ejected from the ejection surface 50*a* of the post-coat head 50 onto the paper sheet P as needed after ink droplets have impinged the paper sheet P. The heads 10, 40, and 50 are aligned at regular intervals in the subscanning direction, and are supported to the casing 1*a* via a head holder 3. That is, the head holder 3 supports the heads 10, 40, and 50 such that the ejection surfaces 10*a*, 40*a*, and 50*a* confront the support surface 8*a* of the conveying belt 8 with an appropriate interval for printing. Configurations of the heads 10, 40, and 50 will be described in greater detail later.

The upstream guide 80A is disposed on the upstream side of the conveying unit 21 in a sheet conveying direction for leading the paper sheet P from a sheet supply unit 1*b* (described later) to the conveying unit 21, and includes guides 27*a* and 27*b* and a pair of feed rollers 26. The downstream guide 80B is disposed on the downstream side of the conveying unit 21 in the sheet conveying direction for leading the paper sheet P from the conveying unit 21 to the discharge section 31, and includes guides 29*a* and 29*b*, and two pairs of feed rollers 28.

The sheet supply unit 1*b* is detachably accommodated in the inner space Y of the casing 1*a*. The sheet supply unit 1*b* includes a sheet supply tray 23 and a sheet supply roller 25. The sheet supply tray 23 is in an open-top box shape and capable of accommodating paper sheets P in various sizes. The sheet supply roller 25 feeds an upper one of the paper sheets P accommodated in the sheet supply tray 23 to the upstream guide 80A.

As described above, the sheet conveying path extending from the sheet supply unit 1*b* to the discharge section 31 via the conveying unit 21 is defined in the inner spaces X and Y. Based on a print command received from an external device, the sheet supply unit 1*b* drives a sheet-supply motor 125 (FIG. 5) for the sheet supply roller 25, a feed motor 127 (FIG. 5) for the guides 80A and 80B, the conveying motor 121 (FIG. 5), and the like.

The paper sheet P fed from the sheet supply tray 23 is supplied to the conveying unit 21 by the feed rollers 26. When the paper sheet P is conveyed directly below each head 10, 40, 50, ink droplets of each color are ejected from the heads 10 in sequence (and droplets of pre-treating agent and droplets of post-treating agent are also ejected from the pre-coat head 40 and the post-coat head 50 if needed). As a result, a color image is formed on the paper sheet P. Ejections of the droplets of the ink and the treating agents are performed under the control of the control device 1*p* based on detection signal output from a sheet sensor 32. The paper sheet P with the image formed thereon is separated from the conveying belt 8 by the separating plate 5, conveyed upward by the pairs of feed rollers 28, and discharged onto the discharge section 31 through an opening 30.

Note that the subscanning direction is parallel to a direction in which the conveying unit 21 conveys the paper sheet P, and the main-scanning direction is parallel to a horizontal plane and perpendicular to the subscanning direction.

The casing 1*a* also accommodates a cartridge unit 1*c* in the inner space Z. The cartridge unit 1*c* is detachable from the casing 1*a*, and includes a tray 35, a pre-treating agent cartridge 41, four ink cartridges 39, and a post-treating agent cartridge 51. These six cartridges 41, 39, and 51 are all accommodated in the tray 35 and juxtaposed next to one another. Each of the cartridges 41, 39, and 51 stores and supplies the pre-treating agent, ink of each color, or the post-treating agent to the corresponding head 40, 10, or 50 through a tube (not shown).

Next, configurations of the heads 10, 40, and 50 will be described in greater detail. Because the heads 10, 40, and 50 have the same configuration, only the configuration of one of the inkjet heads 10 will be described with reference to FIGS. 2 to 4. Note that in FIG. 3 pressure chambers 16 and apertures 15 that are located behind actuator units 17 and that should be depicted in dotted chain lines are depicted in solid lines instead.

Figure 2:
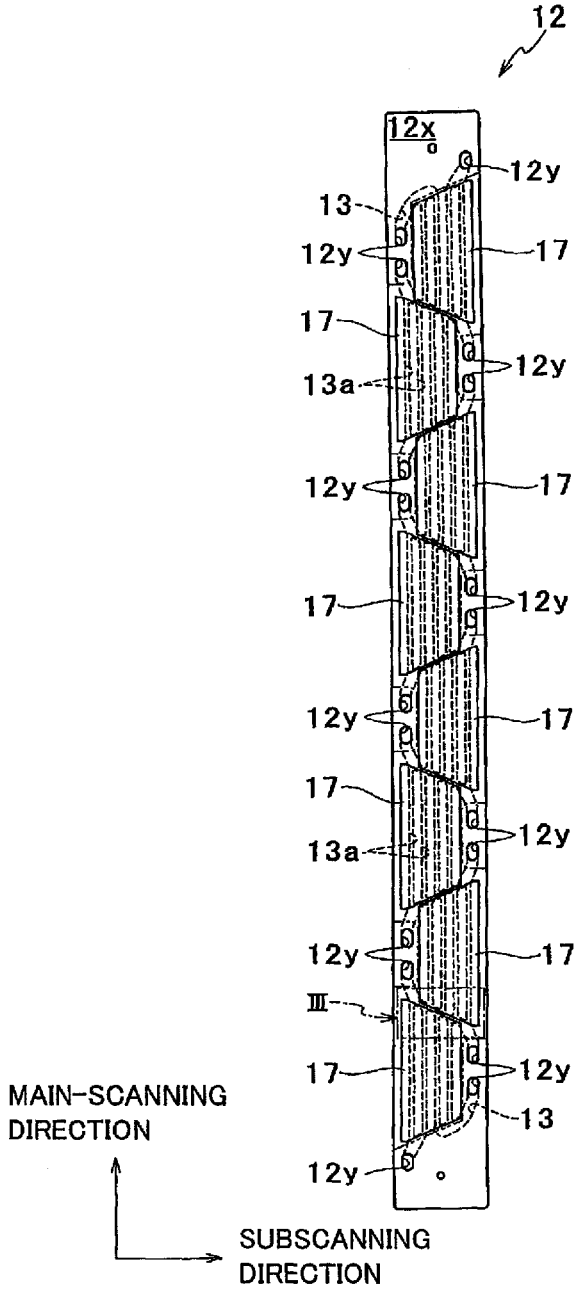
FIG. 2 is a top view of a channel unit and actuator units of an inkjet head according to the embodiment of the invention.

As shown in FIGS. 2 and 4, the inkjet head 10 includes a channel unit 12 having the ejection surface 10*a*, eight actuator units 17 fixed on an upper surface 12*x* of the channel unit 12, a flexible printed circuit (FPC) 19 conned to each actuator unit 17, and a reservoir unit (not shown). The channel unit 12 is formed with a plurality of channels, each fluidly connecting one of openings 12*y* (FIG. 2) formed in the upper surface 12*x* to corresponding nozzles 14*a* formed in the ejection surface 10*a*. Each actuator unit 17 includes piezoelectric actuators in one-to-one correspondence with the nozzles 14*a*.

The reservoir unit (not shown) is formed with a channel including a reservoir for temporarily storing ink supplied from the ink cartridge 39. The reservoir unit has a bottom surface formed with protrusions and recesses. Each protrusion is fixed to the upper surface 12*x* of the channel unit 12 in an area where no actuator unit 17 is disposed (area indicated by two-dotted chain line in FIG. 2, in which the openings 12*y* are formed). Each protrusion is formed in its end with an opening that is in fluid communication with the reservoir and opposing the opening 12*y* of the channel unit 12. Thus, the reservoir is fluidly connected to each individual channel 14 (FIG. 4, described later) via the opening at the end of the protrusion. The recesses, on the other hand, oppose the upper surface 12*x* of the channel unit 12, the surface of the actuator unit 17, and the surface of the FPC 19, with tiny gaps therebetween.

The channel unit 12 is a laminated body formed by laminating and bonding one on the other nine metal plates 12*a*, 12*b*, 12*c*, 12*d*, 12*e*, 12*f*, 12*g*, 12*h*, and 12*i*, having substantially the same size (see FIG. 4). As shown in FIGS. 2, 3, and 4, the channel unit 12 is formed with a plurality of manifold channels 13 having the openings 12*y* at one end, a plurality of sub-manifold channels 13*a* arising from each manifold channel 13, and a plurality of individual channels 14 fluidly connecting the sub-manifold channels 13*a* to the corresponding nozzles 14*a*. The individual channels 14 are formed in one-to-one correspondence with the nozzles 14*a*, and each includes a pressure chamber 16 and an aperture 15. The aperture 15 functions as a throttle for controlling flow channel resistance. A matrix of rhombic-like openings for exposing the pressure chambers 16 are formed in each area of the upper surface 12*x* where the actuator unit 17 is attached. Also, a matrix of the nozzles 14*a* is formed in the same arrangement as the pressure chambers 16 in each area of the ejection surface 10*a* in opposition to the actuator unit 17.

As shown in FIG. 2, the actuator units 17 are in trapezoidal flat shape and arranged in a two-row staggered pattern on the upper surface 12*x* of the channel unit 12. As shown in FIG. 3, each actuator unit 17 covers over the openings of the number of pressure chambers 16 located in the attachment area for the actuator unit 17. Although not shown in the drawings, the actuator unit 17 includes a plurality of piezoelectric layers stretching over the pressure chambers 16 and electrodes sandwiching the piezoelectric layers in a thickness direction. The electrodes include individual electrodes provided in one-to-one correspondence with the pressure chambers 16 and a common electrode provided commonly for the pressure chambers 16. The individual electrodes are disposed on an upper surface of upper one of the piezoelectric layers.

The FPC 19 includes a wiring for each electrode of the actuator unit 17, and a driver IC (not shown) is disposed midway on the wiring. The FPC 19 has one end fixed to the actuator units 17 and the other end fixed to a control board (not shown) of the inkjet head 10 disposed above the channel unit 12. Under the control of the control device 1*p*, the FPC 19 transmits various driving signals output from the control board to the driver IC based on print data to be described later, and transmits signals generated by the driver IC to the actuator units 17.

Note that the treating agent is supplied to the reservoir of the reservoir unit of the pre-coat head 40 or the post-coat head 50 from the corresponding pre-treating agent cartridge 41 or post-treating agent cartridge 51.

The pre-treating agent prevents ink blur and ink seep through, improves color development, reduces dry time, and prevents the paper cockle and curl that may occur after ink ejection. The post-treating agent forms a layer to protect images formed on the paper sheet P by improving rub resistance, water resistance, light resistance, gas resistance, and the like, and to produce gross on the surface of the paper sheet P. The treating agent may be produced from, for example, liquid containing multivalent metal salt such as magnesium salt and cationic polymer.

Next, electrical configuration of the inkjet printer 1 will be described with reference to FIG. 5.

Figure 5:
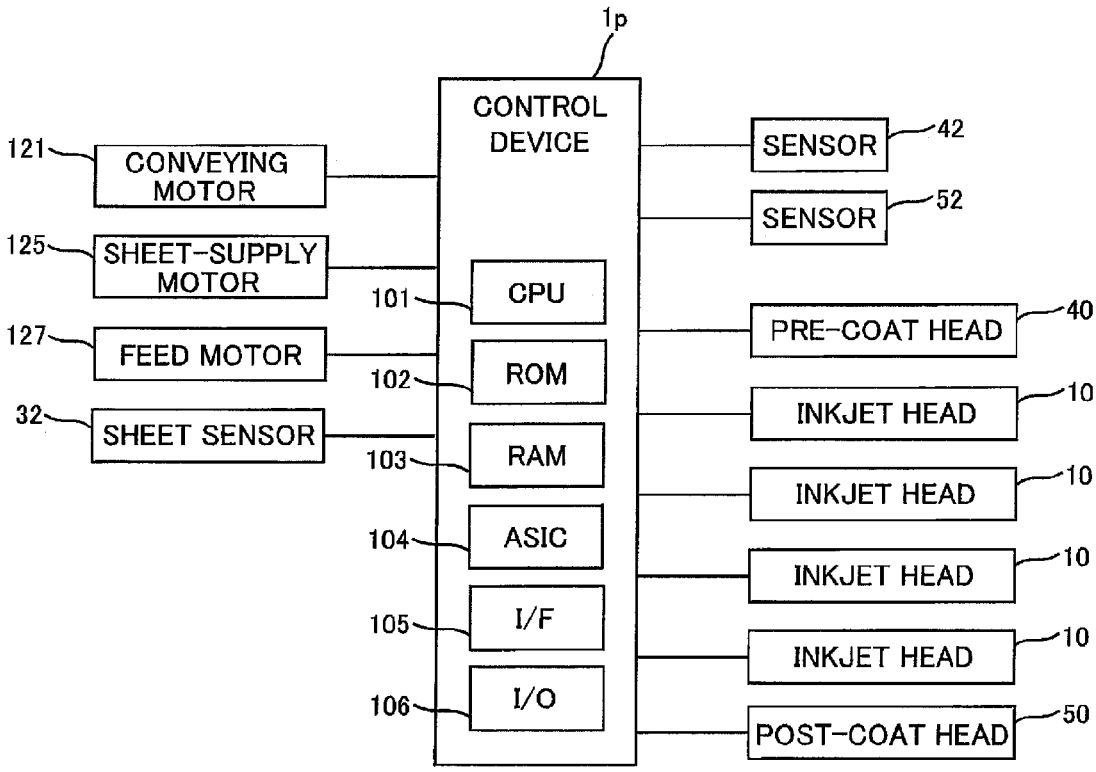
FIG. 5 is a block-diagram showing electrical configuration of the inkjet printer of FIG. 1.

As shown in FIG. 5, the control device 1*p* includes a CPU 101, a ROM 102, a RAM 103 (including non-volatile RAM), an ASIC 104, an interface (I/F) 105, and an input/output port (I/O) 106. The ROM 102 stores programs to be executed by the CPU 101, various fixed data (such as extract conditions to be described later), and the like. The RAM 103 temporarily stores data (such as image data) required for executing programs. The ASIC 104 rewrites and sorts image data (performs signal processing and image processing). The I/F 105 exchanges data between an external device. The I/O 106 inputs and outputs detection signals of various sensors.

The control device 1*p* is electrically connected to the conveying motor 121, the sheet-supply motor 125, the feed motor 127, the sheet sensor 32, the control boards of the heads 10, 40, and 50, and sensors 42 and 52. The sensors 42 and 52 detect the remaining amounts of the treating agents in the cartridges 41 and 51, respectively, and output detection signals to the control device 1*p*.

Next, a printing process executed by the CPU 101 of the control device 1*p* based on a program stored in the ROM 102 will be described with reference to the flowchart of FIG. 6.

The printing process is executed repeatedly while the main power to the inkjet printer 1 is ON.

First in S1 the CPU 101 determines whether or not any print command is received from an external device. If not (S1:No), then the CPU 101 repeats the determination in S1. On the other hand, if so (S1:Yes), then in S2 the CPU 101 stores image data and the like included in the print command into the RAM 103, generates normal print data and normal treating-agent ejection data for each treating agent based on the image data, and calculates normal usage amounts of the pre-treating agent and the post-treating agent. Note that the normal usage amount means an amount of the treating agent expected to be used in a normal mode printing executed in S5. In this embodiment, an average amount consumed when the normal mode printing is performed on a single sheet paper P has previously been stored in the ROM 102 for each of the pre-treating agent and the post-treating agent, and the normal usage amount is calculated by multiplying the average amount by the number of paper sheet P to be printed, which is obtained from the print command received in S1.

Then, in S3, the CPU 101 calculates remaining amounts of the pre-treating agent and the post-treating agent based on detection signals from the sensors 42 and 52. In S4, the CPU 101 determines whether or not the remaining amount is less than the normal usage amount calculated in S2 for each of the pre-treating agent and the post-treating agent.

If the remaining amounts of both of the pre-treating agent and the post-treating agent are not less than the corresponding normal usage amounts (S4:No), then in S5 the CPU 101 executes a normal mode printing process by controlling various components of the inkjet printer 1. Then, the CPU 101 ends the printing process.

On the other hand, if the remaining amount of at least one of the pre-treating agent and the post-treating agent is less than the corresponding normal usage amount (S4:Yes), then in S6 the CPU 101 notifies a user of this determination result by, for example, displaying a message "(pre and/or post) treating agent is lacking. Should printing continue in a treating-agent non-use mode?" on a display of the inkjet printer 1 or the external device.

In S7, the CPU 101 determines whether or not to execute the printing in the treating-agent non-use mode, based on user input, which has been input via a keyboard or a mouse of the external device and output to the control device 1*p*. If so (S7:Yes), then the CPU 101 executes a non-use mode printing process in S8 and ends the printing process. On the other hand, if not (S7:No), then the CPU 101 executes a limited mode printing process in S9, and then ends the printing process.

Note that in the normal mode printing process in S5, the normal mode printing is performed for ejecting ink droplets based on the normal print data while conveying a paper sheet P at a normal conveying speed that is prestored in the ROM 102. Also, each treating agent is applied at a predetermined normal density across the entire image forming region on the paper sheet P based on the normal treating-agent ejection data. In the non-use mode printing process in S8, the treating agent(s), which has been determined in S4 to have the remaining amount less than the normal usage amount (hereinafter referred to as "insufficient treating agent"), is not applied to the paper sheet P. In the limited mode printing process in S9, the insufficient treating agent(s) is applied to each paper sheet P by an amount less than that for the normal mode printing.

Figure 7:
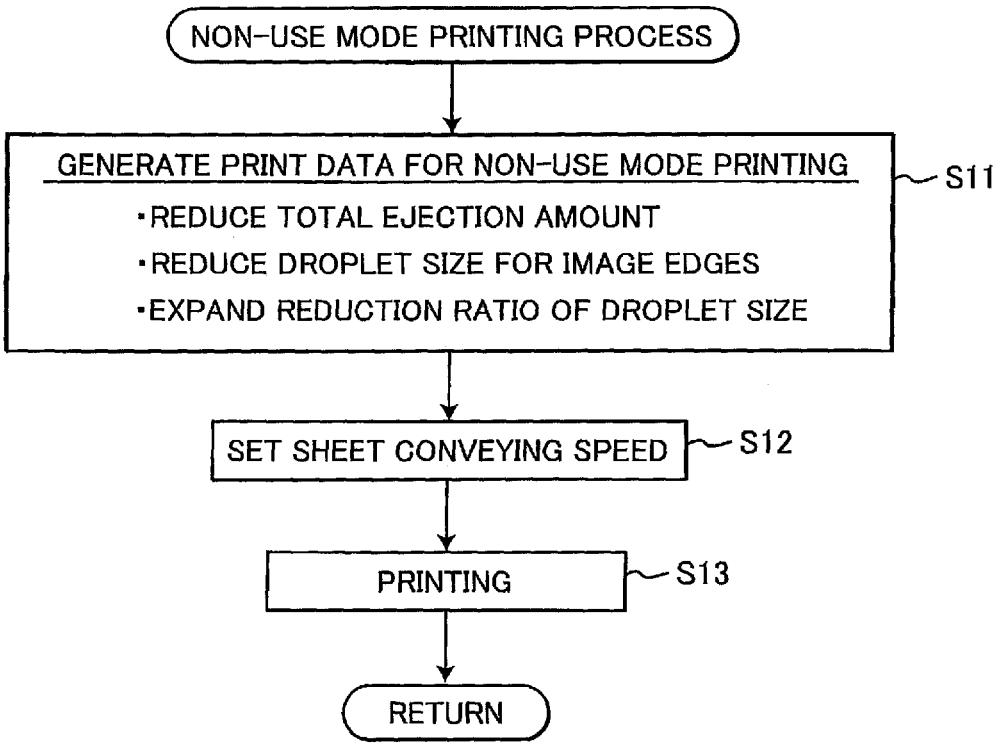
FIG. 7 is a flowchart representing a non-use mode printing process according to the embodiment of the invention.

Next, detail of the non-use mode printing process executed in S8 will be described with reference to the flowchart of FIG. 7.

First in S11, the CPU 101 generates print data for the non-use mode printing. The print data is generated by converting the image data included in the print command in accordance with the arrangement of the nozzles 14*a* of the inkjet head 10, and is data specifying ejection from each nozzle 14*a*. The actuators of the inkjet head 10 are driven based on the print data. The print data for the non-use mode printing is generated with reference to the normal print data so as to reduce a total ejection amount of ink on each paper, to reduce the size of ink droplets ejected for edges of the image, to increase a reduction ratio of droplet size, for preventing problems that may occur because the insufficient treating agent is not used (ink blur, ink seep through, and the like).

Next in S12, having regard to the effects of the print data generated in S11 and the non-use of the insufficient treating agent on dry time, the CPU 101 sets a sheet conveying speed, i.e., the circulation speed of the conveying belt 8, with reference to the normal conveying speed stored in the ROM 102.

Then, in S13, the CPU 101 performs the non-use mode printing by controlling various components of the inkjet printer 1. That is, the CPU 101 controls each motor 121, 125, and 127 to convey the paper sheet P at the sheet conveying speed set in S12, and controls the actuator units 17 of each head 10 in synchronization with the sheet convey so as to eject ink droplets of each color based on the print data generated in S11. At this time, one or both of the pre-coat head 40 and the post-coat head 50 corresponding to the insufficient treating agent(s) is not driven. If either one of the pre-treating agent and the post-treating agent has been determined that its remaining amount is not less than the normal usage amount in S4, then corresponding one of the pre-coat head 40 and the post-coat head 50 is driven in the same manner as in the normal mode printing, based on the normal treating-agent ejection data. Then, the CPU 101 ends the non-use mode printing process.

Figure 8:
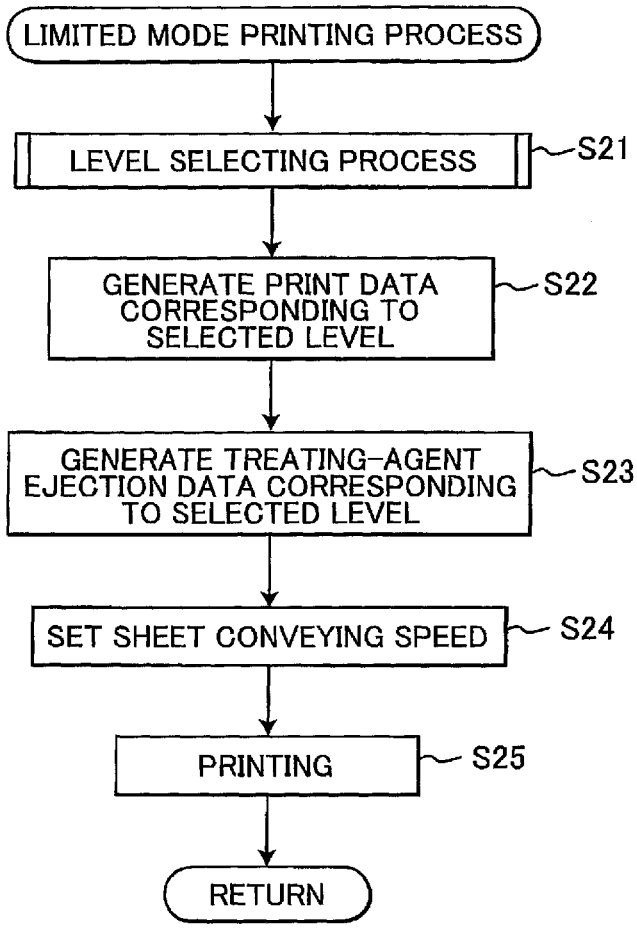
FIG. 8 is a flowchart representing a limited mode printing process according to the embodiment of the invention.

Next, the limited mode printing process executed in S9 of FIG. 6 will be described with reference to the flowchart of FIG. 8.

Figure 9:
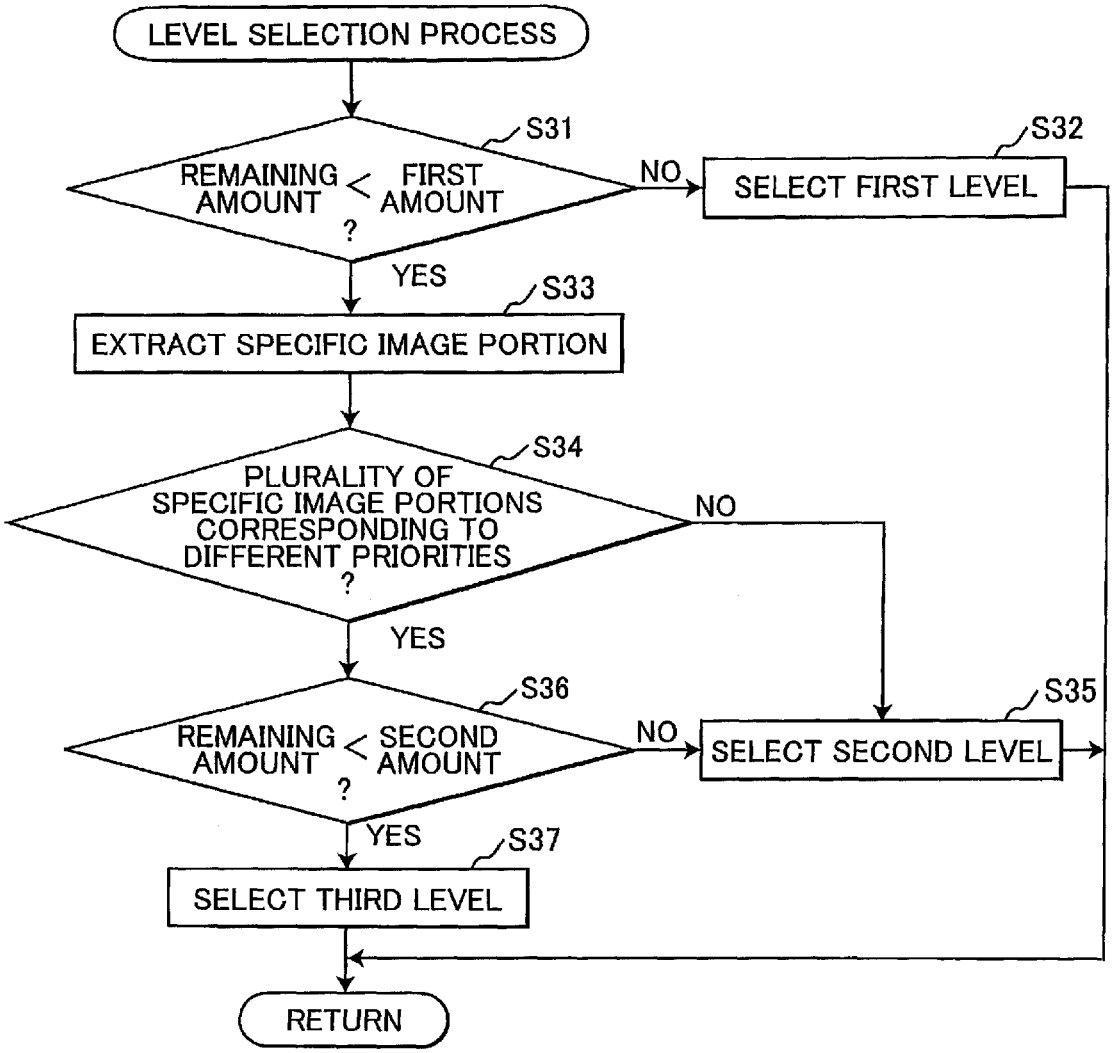
FIG. 9 is a flowchart representing a level selection process according to the embodiment of the invention.

First in S21 the CPU 101 executes a level selection process; which will be described with reference to the flowchart of FIG. 9.

In this embodiment, one of first to three levels is selected in the limited mode selection process, based on the remaining amount of the insufficient treating agent. Note that if both the pre-treating agent and the post-treating agent are determined as the insufficient treating agents, then the level selection process in FIG. 9 is repeated twice, i.e., once for each treating agent, so as to select a level for each agent.

When the first level is selected, the insufficient treating agent is applied to the entire image forming region on the paper sheet P at a density lower than the normal density. When the second level is selected, the insufficient treating agent is applied to a first section in the image forming region at the normal density, and is applied to a second section in the image forming region at a density lower than the normal density. The first region is where a specific image portion is formed, and the second region is where a non-specific image portion is formed. When the third level is selected, the insufficient treating agent is applied to a fourth section in the image forming region at the normal density, and is applied to the second section and a third section in the image forming region at a density lower than the normal density. The fourth section is where a high-priority specific image portion is formed, and the third section is where a low-priority specific image portion is formed.

The specific image portion is a part of an image to be formed on the paper sheet P. The non-specific image portion is a part of the image other than the specific image portion. The specific image portion is divided into a plurality of image parts having different priorities, and the high-priority specific image portion is a part of the specific image portion corresponding to one or more of the image parts with a larger priority than a predetermined priority. The low-priority specific image portion is a part of the specific image portion other than the high-priority specific image portion. The entire of the image forming region is divided into the first and second sections, and the first section is divided into the third and fourth sections.

In the level section process, first in S31, the CPU 101 determines whether or not the remaining amount of the insufficient treating agent is less than a first amount, which is an amount of treating agent that is expected to be used when the first level is selected. In this embodiment, an average usage amount in the first level for a single sheet is prestored in the ROM 102 for each of the pre-treating agent and the post-treating agent, and the first amount is obtained by multiplying the average usage amount by the number of paper sheets P to be printed, which is obtained from the print command received in S1.

If the remaining amount of the treating agent is not less than the corresponding first amount (S31:No), then the CPU 101 selects the first level in S32, and ends the level selection process.

On the other hand, if at least the remaining amount is less than the first amount (S31:Yes), then in S33 the CPU 101 extracts a part of an image to be formed as a specific image portion for each sheet, based on the image data and the like included in the print command received in S1, with reference to extract conditions stored in the ROM 102.

Specifically, the ROM 102 stores a plurality of different extract conditions and a priority order of the extract conditions for each of print conditions, which are combinations of agent type (the pre-treating agent or the post-treating agent), print type (single-side printing or both-side printing), and sheet type. In this embodiment, sheets are classified into a first type and a second type, according to thickness and materials of the sheets. First type of sheets are sheets through which ink easily seeps to the other side, and second type of sheets are sheets on which ink easily blurs. For example, a sheet with a thickness less than a predetermined thickness may be classified into the first type. The print type and the sheet type are determined based on data included in the print command. The agent type corresponds to the insufficient treating agent.

When the agent type is the pre-treating agent, a pixel area of the image is extracted as a specific image portion if the pixel area matches any one of the following extract conditions.

For the single-side printing on a first type of sheet, there are provided extract conditions for preventing ink seep through (A), extract conditions for preventing ink blur (B), and extract conditions for preventing poor color development (C), in the order from highest priority to lowest priority ((A)>(B)>(C)).

For the single-side printing on a second type of sheet, there are provided the extract conditions (B), (A), and (C), in the order from highest priority to lowest priority ((B)>(A)>(C)).

For the both-side printing, the same extract conditions (A), (B), and (C) as for the single-side printing on a first type of sheet are provided, without regard to the sheet type ((A)>(B)>(C)).

The extract conditions (A) for the single-side printing include an extract condition (A1) that ink is ejected for a pixel area by an amount equal to or greater than a predetermined amount, and an extract condition (A2) that lightness of ink to be ejected for a pixel area is less than a predetermined value, in the order of higher priority to lower priority ((A1)>(A2)). Note that each pixel area includes a predetermined number of one or more pixels in this embodiment, but the number of pixels may vary among different extract conditions.

The extract conditions (A) for the both-side printing include the above-described extract conditions (A1) and (A2) and also an extract condition (A3) that a position of a pixel area on a paper sheet P corresponds to a character image to be printed on the other side of the paper sheet P, and the priority order thereof is (A1), (A2), and (A3), i.e., (A1)>(A2)>(A3). Note that the character image includes letters and symbols, in this description.

The predetermined amount set for the extract condition (A1) and the predetermined value set for the extract condition (A2) are an ink amount and a lightness value, respectively, that would let ink seep through in the corresponding pixel area.

The extract conditions (B) include an extract condition (B1) that a pixel area corresponds to an edge of an image (particularly a line image) to be formed, and an extract condition (B2) that a pixel area is included in a character image, in the order of highest priority to lowest priority ((B1)>(B2)). The line image means an image whose ratio of a length in one direction to a length in another direction perpendicular to the one direction is equal to or more than a predetermined amount. In this embodiment, a pixel area in adjacent to a colorless part is particularly extracted as a specific image portion in accordance with the extract condition (B1), thereby preventing the colorless part of a line image (a part of image located between lines with less than a predetermined gap therebetween) from being squashed and deleted.

The extract conditions (C) include an extract condition (C1) that a pixel area has an optical density value that is predetermined to require application of the pre-treating agent, an extract condition (C2) that a pixel area has a gray value that is predetermined to require application of the pre-treating agent, and an extract condition (C3) that a pixel area has a density variation value equal to or greater than a predetermined value, in the order from highest priority to lowest priority ((C1)>(C2)>(C3)).

On the other hand, when the agent type is the post-treating agent, then without regard to the sheet type or the print type, a pixel area is extracted as a specific image portion if the pixel area matches one of extract conditions (D) including an extract condition (D1) that ink is ejected for a pixel area by an amount equal to or more than a predetermined amount ((D1)=(A1)), and an extract condition (D2) that a pixel area corresponds to an edge of an image (particularly a line image) to be formed ((D2)=(B1)), in the order of higher priority to lower priority ((D1)>(D2)). In accordance with the extract condition (D2), particularly an edge of an image near an edge of the paper sheet P is extracted as a particular image portion.

After the process of S33, the CPU 101 determines in S34 whether or not a plurality of specific image portions is extracted according to the extract conditions of different priorities. If only a specific image portion(s) corresponding to the same priority is extracted, then a negative determination is made in S34 (S34:No). In this case, the CPU 101 proceeds to S35 to select the second level, and then ends the level selection process.

On the other hand, if a plurality of specific image portions corresponding to a plurality of different priorities (S34:Yes), then the CPU 101 determines in S36 whether or not the remaining amount of the treating agent determined in S3 is less than a second amount. The second amount is an amount of treating agent that is expected to be used when the second level is selected, and is calculated based on the extracted specific image portions and non-specific image portions of each paper.

If not (S36:No), then the CPU 101 selects the second level in S35, and ends the level selection process. On the other hand, if so (S36:Yes), then the CPU 101 selects the third level in S37, and then ends the level selection process. Note that in S36 the CPU 101 also determines a high-priority specific image portion for the third level based on the specific image portions extracted in S33 and the remaining amount of the treating agent.

For example, if the agent type is the pre-treating agent, and if single-side printing is performed on a first type of sheet, then one or more of the specific image portions extracted based on one or more of the extract conditions (A), (B), and (C) (for example, the extract condition (A) with highest priority, or two of the extract conditions (A) and (B) with top two priorities, or two of the extract conditions (A1) and (A2) with top two priorities among the three conditions included in the extract condition (A)) is determined as the high-priority specific image portion, based on the remaining amount.

If the agent type is the pre-treating agent, and if single-side printing is performed on a first type of sheet, then one or more of the specific image portions extracted based on one or more of the extract conditions (B), (A)), and (C) (for example, the extract condition (A) with highest priority, or two of the extract conditions (B) and (A) with top two priorities, or the extract condition (B1) with higher priority of the two conditions included in the extract conditions (B)) is determined as the high-priority specific image portion, based on the remaining amount.

If the agent type is the post-treating agent, then one or more of the specific image portions extracted based on one or more of the extract conditions (D1) and (D2) (for example, the extract condition (D1) with the highest priority) is determined as the high-priority specific image portion, based on the remaining amount.

After the level selection process in S21 completes, next in S22, the CPU 101 generates print data corresponding to the selected level(s) (level(s) selected in S21). More specifically, the CPU 101 generates the print data for each sheet based on the selected level in the similar manner as in S11, with reference to the normal print data.

Then in S23 the CPU 101 generates treating-agent ejection data corresponding to the selected level for each of the insufficient treating agent(s). The treating-agent ejection data is generated based on the image data and the like included in the print command received in S1 and specifies ejection from the corresponding head 40, 50. The actuators of the head 40, 50 are driven based on the treating-agent ejection data. The treating-agent ejection data is generated based on the selected level with reference to the normal treating-agent ejection data so as to reduce ejection amount for one or both of the non-specific image portion and the low-priority specific image portion.

In S24, having regard to the effects of the print data generated in S22 and the treating-agent ejection data generated in S23 on dry time, the CPU 101 sets the paper conveying speed, i.e., the circulation speed of the conveying belt 8, with reference to the normal conveying speed stored in the ROM 102.

Then, the CPU 101 executes the limited mode printing in S25 by controlling various components of the inkjet printer 1. Specifically, the CPU 101 controls each motor 121, 125, and 127 to convey the paper sheet P at the sheet conveying speed set in S24, and controls the actuator units 17 of each head 10 in synchronization with the sheet convey so as to eject ink droplets of each color based on the print data generated in S22. At this time, the actuator unit is controlled such that one or both of the pre-coat head 40 and the post-coat head 50 corresponding to the insufficient treating agent(s) ejects the treating agent(s) based on the treating-agent ejection data generated in S23. If either one of the pre-treating agent and the post-treating agent has been determined that its remaining amount is not less than the normal usage amount in S4, then corresponding one of the pre-coat head 40 and the post-coat head 50 is driven in the same manner as in the normal mode printing, based on the normal treating-agent ejection data. Then, the CPU 101 ends the limited mode printing process.

As described above, according to the present embodiment, if the remaining amount of the treating agent is less than the first amount (S31:Yes), then the second level is selected (S35) to reduce the amount of the treating agent applied to the second section in the image forming region where the non-specific image portion is formed and to apply the same amount of the treating agent as that for the normal mode printing to the first section where the specific image portion is formed. That is, even when the remaining amount of the treating agent becomes low, the treating agent is applied to the first section to secure a certain level of image quality, which is not secured if no treating agent is applied to any section in the image forming area as the conventional technology.

Also, by setting the first amount to a relatively large amount, the second level is selected in S35 before the treating agent runs out completely, thereby delaying running out of the treating agent to provide a user more time for replenishing the treating agent.

Ink seep through occurs more likely in a pixel area where a larger amount of ink is ejected. Also, ink that was ejected in correspondence with such a pixel area and that dried on a paper sheet P has a certain thickness, and its surface is not flash with the surface of the paper sheet P. Thus, such ink tends to be scraped by rubbing after printing. By extracting a pixel area for which ink is ejected by an amount equal to or greater than the predetermined amount according to the extract condition (A1), (D1) as a specific image portion, it is possible to prevent ink seep through and to improve rub resistance in this area.

According to this embodiment, the priorities of the extract conditions are predetermined. Also, when the remaining amount of the treating agent is less than the second amount (S36:Yes), the third level is selected (S37). This configuration reduces the amount of the treating agent applied to the third section in the image forming region where the low-priority specific image portion is formed, but applies the same amount of the treating agent as in the normal mode printing to the fourth section where the high-priority specific image portion is formed. Thus, even when the remaining amount of the treating agent becomes extremely low, the treating agent is applied to the fourth section to secure a certain level of image quality.

Ink easily blurs at edges of an image (especially, a line image) formed on a paper sheet P. Also, edges of an image near an edge of a paper sheet P is more likely rubbed by a user's hand holding the paper sheet P. By extracting a pixel area corresponding to an edge of an image (line image) to be formed on a paper sheet P as a specific image portion in S33 in accordance with the extract condition (B1), (D2) in this embodiment, it is possible to prevent ink blur and improve rub resistance in this pixel area.

Ink seep through occurs more likely at a lower lightness pixel area, and abrasion in such area significantly degrades visibility. By extracting a pixel area for which ink with lightness less than the predetermined value as a specific image portion in S33 in accordance with the extract condition (A2)

in this embodiment, it is possible to prevent ink seep through and to improve rub resistance at this area, thereby preventing degradation in visibility.

Also, by extracting a pixel area with an optical density value that is predetermined to require application of the treating agent is extracted as a specific image portion in S33 in accordance with the extract condition (C1), a desired optical density value can be obtained even when the remaining amount of the treating agent is low.

By extracting a pixel area with a gray value that is predetermined to require application of the treating agent as a specific image portion in S33 in accordance with the extract condition (C1), a desired gray value can be obtained even when the remaining amount of the treating agent is low.

If ink blur or poor color development occurs in a pixel area with a relatively large density variation value, then the contrast is decreased. By extracting a pixel area with a density variation value equal to or greater than the predetermined value as a specific image portion in S33 in accordance with the extract condition (C3), it is possible to suppress reduction in the contrast, thereby securing a certain level of image quality.

According to the embodiment, there is provided a plurality of different extract conditions for a plurality of sheet types, and a different pixel area is extracted as a specific image portion based on the sheet type. Thus, it is possible to reduce such problems as ink bur and ink seep through.

Likelihood of occurrence of such problems as ink blur and ink seep through varies depending on sheet type and lightness value of ink to be ejected. Thus, it is preferable that the CPU 101 change the first amount and/or the amount of treating agent to be applied to the first section in the image forming area based on one or both of the sheet type of the lightness value.

For example, if the lightness of ink to be ejected is less than the predetermined value or if printing is performed on a such a sheet with which ink seep through or ink blur easily occurs, then the first amount may be set to a higher amount than for other cases such that the second level is selected even if the remaining amount of the treating agent is relatively large. By selecting the second level, the treating agent is applied to the first section in the image forming area at the normal density, thereby effectively preventing such problems as ink blur and ink seep through. Alternatively, the amount of treating agent to be applied to the first section in the image forming region may be increased compared to the amount for the other cases, thereby effectively preventing such problems as ink blur and ink seep through.

When the second level is selected, then the CPU 101 controls the pre-coat head 40 or the post-coat head 50 in the limited mode printing process (S9) such that the amount of treating agent applied to the second section of the sheet is gradually reduced in proportion to a distance from the first section of the sheet. This prevents boundary between the specific image portion and the non-specific image portion from being noticeable.

When ink seeps through a sheet to a character image on the other side of the sheet, visibility of the character image is significantly degraded. Thus, the treating agent is preferably applied an area corresponding to the character image on the other side of the sheet at a density equal to or greater than the normal density. This configuration prevents ink seep through at this area, thereby preventing degradation in visibility.

In this embodiment, a single mode (one of the normal mode printing, the non-use mode printing, the limited mode printing with selected level) is selected each time a single print command is received. In other words, modes are not switched during printing based on a single print command. For example, when printing a two-page spread based on a single print command, if printing is performed on two pages in different modes, then quality of resultant image may be degraded due to different color densities. Also, when both-side printing is performed, if a mode for one surface differs from a mode for the other surface, then sheet may curl because of difference in amount of treating agent applied to each surface. The present embodiment, however, can prevent such problems.

The remaining amount of the treating agent detected in S3 may be the remaining amount as of execution of S3 or an amount obtained by subtracting an usage estimate from the remaining amount as of execution of S3.

In the latter case, the usage estimate may be set to an amount of treating agent estimated to be used in a time period (one week, for example) that is required for a user to purchase a new treating-agent cartridge, based on a treating-agent consumption history of the inkjet printer 1. By taking the usage estimate into consideration, it is possible to complete the limited mode printing without running out of treating agent during the printing.

In the former case, it is preferable to determine between S3 and S4 whether or not an amount obtained by subtracting the usage estimate from the remaining amount as of execution of S3 is less than the normal usage amount and to display a message urging a user to prepare a new treating-agent cartridge if the amount is less than the normal usage amount, so that the limited mode printing can complete without running out of treating agent during the printing.

While the invention has been described in detail with reference to the embodiment thereof, it would be apparent to those skilled in the art that various changes and modifications may be made therein without departing from the spirit of the invention.

For example, it is possible not to control the pre-coat head 40 or the post-coat head 50 such that the amount of treating agent applied to the second section of the sheet is gradually reduced in proportion to a distance from the first section of the sheet.

Also, it is possible not to change the first amount and/or the amount of treating agent to be applied to the first section on the sheet based on the sheet type and/or the lightness of ink to be ejected.

The extract conditions are not limited to those described above, but may be modified in various manners. For example, a specific image portion may be extracted based on the same condition, without regard to the sheet type. In this case, it is unnecessary to provide a plurality of different conditions for a plurality of different sheet types. Also, a specific image portion may be extracted based on the same condition, without regard to the print type.

The above-described priority order of the extract conditions is mere example, and may be changed in various manners. Also, the plurality of different conditions may not be prioritize. Alternatively, there may be provided only a single condition.

In the above-described embodiment, the second section of the sheet is where a non-specific image portion is formed. However, the second section may be a section where at least part of non-specific image portion is formed. In this case, an amount of treating agent to be applied to a section where at least part of non-specific image portion is formed is reduced when the second level is selected in the limited mode printing process.

The amount of treating agent applied to a second section (where at least part of non-specific image portion is printed)

when the second level is selected in the limited mode printing process and the amount of treating agent applied to a second section and a third section (where a lower-priority specific image portion is formed) when the third level is selected in the limited mode printing process may be zero amount.

In the above-described embodiment, each treating agent is applied to the entire image forming region at the predetermined normal density in the normal mode printing process. However, how to apply the treating agents in the normal mode printing process is not limited to that described in the above embodiment. For example, an application amount of treating agent for each image forming section in an image forming region corresponding to each pixel may be determined based on an ejection amount of ink. Similarly, in the limited mode printing process, an application amount of treating agent for each image forming section in an image forming region corresponding to each pixel may be determined based on an ejection amount of ink, instead of applying the treating agent at the same density to the entire image forming region or the entire section. By determining the application amount for each image forming section, the treating agent consumption amount can be reduced.

The normal usage amount may be calculated in a different manner. For example, the normal usage amount may be calculated based on ejection amounts of ink droplets for each pixel that can be obtained from the image data stored in the RAM 103 in S1. Note that the above-described application amount of treating agent for each image forming section corresponding to each pixel can be calculated in the same manner in S5. The first amount and the second amount in S31 and S36 may also be calculated in a manner differing from those described above.

Figure 6:
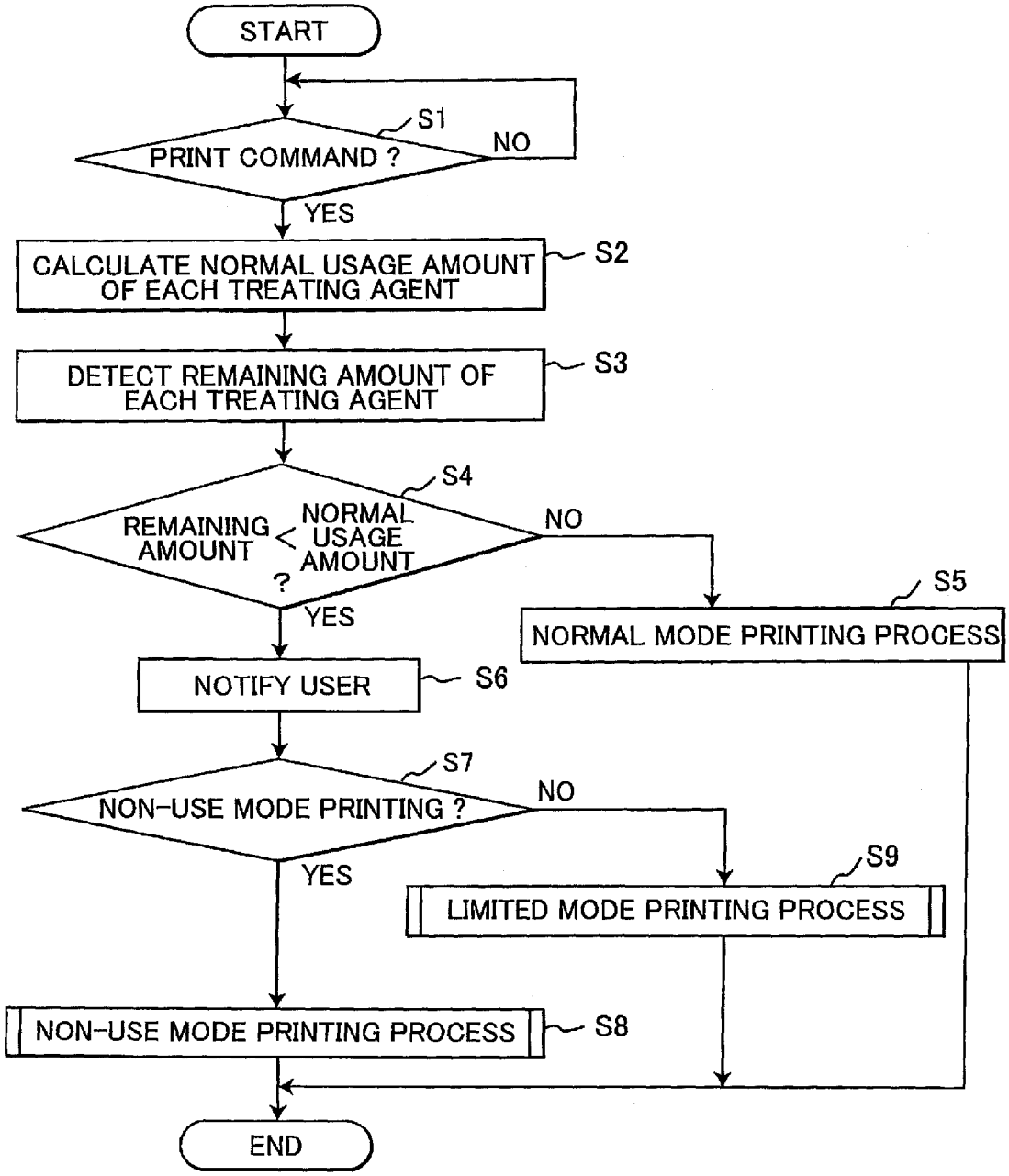
FIG. 6 is a flowchart representing a printing process executed in the inkjet printer according to the embodiment of the invention.

The process in S2 of FIG. 6 may be omitted, and the above-described usage estimate may be used instead of the normal usage amount in S4.

In the above-described embodiment, there are provided the first to third levels for the limited mode printing process. However, the first and third levels may be deleted.

The treating agent may not be liquid, but may be solid (including films).

In the above-described embodiment, the usage amounts of both the pre-treating agent and the post-treating agent are controlled in accordance with the remaining amounts thereof. However, only the usage amount of either the pre-treating agent or the post-treating agent may be controlled in the above-described manner. Also, the inkjet printer 1 may include only one of the pre-coat head 40 and the post-coat head 50.

The inkjet heads 10, the pre-coat head 40, and the post-coat head 50 may include electrostatic actuators or thermal actuators, instead of the piezoelectric actuators.

The above-described pre-coat head 40 and the post-coat head 50 have the same configuration as the inkjet heads 10. However, the pre-coat head 40 and the post-coat head 50 may have different configurations. For example, each of the pre-coat head 40 and the post-coat head 50 may use a roller (pressure roller, thermal transfer roller, or the like) for applying the treating agent by contacting its surface supporting the treating agent to the sheet surface.

The present invention is applicable to a line printer and a serial printer, and also to a facsimile device and a copier device. A head of the invention is not limited to the inkjet head 10, but may be a head that eject liquid other than ink.

A recording medium is not limited to the paper sheet P, but may be any other medium.

What is claimed is:

1. A droplet ejection device comprising:

a first storing unit configured to store image data;

a head configured to eject droplets onto a recording medium so as to form an image corresponding to the image data;

a treating-agent application member configured to apply a treating agent to the recording medium;

an extract unit configured to extract a part of the image as a specific image portion based on the image data;

a control unit configured to control the treating-agent application member to apply the treating agent to a first section and a second section of the recording medium, wherein the specific image portion is formed in the first section, and at least a part of a non-specific image portion of the image other than the specific image portion is formed in the second section;

a detection unit configured to detect a remaining amount of the treating agent;

a first determining unit configured to determine whether or not the remaining amount is less than a first amount;

a second storing unit configured to store a plurality of different extract conditions and a priority order of the extract conditions; and a second determining unit configured to determine whether or not the remaining amount is less than a second amount, which is less than the first amount, wherein, when the remaining amount is less than the first amount, the control unit is configured to control the treating-agent application member to apply the treating agent to the second section by an amount less than an amount of the treating agent that is applied to the second section when the remaining amount is not less than the first amount, wherein the extract unit is configured to extract, as the specific image portion, a part of the image that matches any one of the extract conditions, wherein, when the remaining amount is less than the second amount, and when the extract unit extracts a plurality of specific image portions corresponding to a plurality of different priorities of the extract conditions, the control unit is configured to control the treating-agent application member to apply the treating agent to a third section of the recording medium by an amount less than an amount of the treating agent that is applied to the third section when the remaining amount is not less than the second amount, and wherein the plurality of specific image portions includes a high-priority specific image portion corresponding to a priority higher than a predetermined priority and a low-priority specific image portion other than the high-priority specific image portion, the low-priority image portion being formed in the third section of the recording medium.

2. The droplet ejection device according to claim 1, wherein the part of the image extracted as the specific image portion is a pixel area for which the droplets of an amount equal to or greater than a predetermined amount are ejected, wherein the pixel area includes a predetermined number of at least one pixel.

3. The droplet ejection device according to claim 1, wherein the part of the image extracted as the specific image portion is a pixel area corresponding to an edge of the image, the pixel area including a predetermined number of plural pixels.

4. The droplet ejection device according to claim 3, wherein the image is a line image.

5. The droplet ejection device according to claim 1, wherein the part of the image extracted as the specific image portion is a pixel area for which the droplets with lightness less than a predetermined value are ejected, the pixel area including a predetermined number of at least one pixel.

6. The droplet ejection device according to claim 1, wherein the part of the image extracted as the specific image portion is a pixel area with an optical density value that is predetermined to require application of the treating agent, the pixel area including a predetermined number of at least one pixel.

7. The droplet ejection device according to claim 1, wherein the part of the image extracted as the specific image portion is a pixel area with a gray value that is predetermined to require application of the treating agent, the pixel area including a predetermined number of at least one pixel.

8. The droplet ejection device according to claim 1, wherein the part of the image extracted as the specific image portion is a pixel area with a density variation value that is predetermined to require application of the treating agent, the pixel area including a predetermined number of plural pixels.

9. The droplet ejection device according to claim 1, further comprising a third storing unit configured to store a plurality of different extract conditions corresponding to a plurality of different medium type, wherein the extract unit is configured to extract a part of the image that matches any one of the extract conditions.

10. The droplet ejection device according to claim 1, further comprising a changing unit that changes at least one of an amount of the treating agent to be applied to the first section and the first amount, based on at least one of lightness of the droplets to be ejected and type of the recording medium.

11. The droplet ejection device according to claim 1, wherein when the remaining amount is less than the first amount, the control unit controls the treating-agent application member to apply the treating agent to the second section such that an amount of the treating agent applied to the second section is gradually reduced in proportion to a distance from the first section of the recording medium.

12. A control device configured to control a droplet ejection device including a head configured to eject droplets onto a recording medium so as to form an image corresponding to image data and a treating-agent application member configured to apply a treating agent to the recording medium, comprising:

a first storing unit configured to store the image data;

an extract unit configured to extract a part of the image as a specific image portion based on the image data;

a control unit configured to control the treating-agent application member to apply the treating agent to a first section and a second section of the recording medium, wherein the specific image portion is formed in the first section, and at least a part of a non-specific image portion of the image other than the specific image portion is formed in the second section;

a detection unit configured to detect a remaining amount of the treating agent;

a first determining unit configured to determine whether or not the remaining amount is less than a first amount;

a second storing unit configured to store a plurality of different extract conditions and a priority order of the extract conditions; and a second determining unit configured to determine whether or not the remaining amount is less than a second amount, which is less than the first amount, wherein, when the remaining amount is less than the first amount, the control unit is configured to control the treating-agent application member to apply the treating agent to the second section by an amount less than an amount of the treating agent that is applied to the second section when the remaining amount is not less than the first amount, wherein the extract unit is configured to extract, as the specific image portion, a part of the image that matches any one of the extract conditions, wherein, when the remaining amount is less than the second amount, and when the extract unit extracts a plurality of specific image portions corresponding to a plurality of different priorities of the extract conditions, the control unit is configured to control the treating-agent application member to apply the treating agent to a third section of the recording medium by an amount less than an amount of the treating agent that is applied to the third section when the remaining amount is not less than the second amount, and wherein the plurality of specific image portions includes a high-priority specific image portion corresponding to a priority higher than a predetermined priority and a low-priority specific image portion other than the high-priority specific image portion, the low-priority image portion being formed in the third section of the recording medium.

13. A non-transitory computer readable storage medium storing a set of program instructions for a computer configured to control a droplet ejection device including a head configured to eject droplets onto a recording medium to form an image corresponding to image data and a treating-agent application member configured to apply a treating agent to the recording medium, the program instructions, when executed by the computer, instructing the computer to perform processes comprising:

extracting a part of the image as a specific image portion based on the image data stored in a storing unit;

controlling the treating-agent application member to apply the treating agent to a first section and a second section of the recording medium, wherein the specific image portion is formed in the first section, and at least a part of a non-specific image portion of the image other than the specific image portion is formed in the second section;

detecting a remaining amount of the treating agent; and determining whether or not the remaining amount is less than a first amount, wherein, when the remaining amount is less than the first amount, the controlling comprises controlling the treating-agent application member to apply the treating agent to the second section by an amount less than an amount of the treating agent that is applied to the second section when the remaining amount is not less than the first amount, wherein the extracting comprises extracting, as the specific image portion, a part of the image that matches any one of the extract conditions, wherein, when the remaining amount is less than a second amount, which is less than the first amount, and when a plurality of specific image portions corresponding to a plurality of different priorities of the extract conditions are extracted during the extracting, the controlling comprises controlling the treating-agent application member to apply the treating agent to a third section of the recording medium by an amount less than an amount of the treating agent that is applied to the third section when the remaining amount is not less than the second amount, and wherein the plurality of specific image portions includes a high-priority specific image portion corresponding to a priority higher than a predetermined priority and a low-priority specific image portion other than the high-priority specific image portion, the low-priority image portion being formed in the third section of the recording medium.

* * * * *